United States Patent [19]

Amsler

[11] 4,091,251

[45] May 23, 1978

[54] VACUUM SWITCH

[75] Inventor: Joachim Amsler, Seon, Switzerland

[73] Assignee: Sprecher & Schuh AG, Aarau, Switzerland

[21] Appl. No.: 663,075

[22] Filed: Mar. 2, 1976

[51] Int. Cl.[2] ..... H01H 33/12

[52] U.S. Cl. ..... 200/146 AA; 200/144 B; 200/83 D

[58] Field of Search ..... 200/83 C, 83 D, 146 A, 200/146 AA, 144 B

[56] References Cited

U.S. PATENT DOCUMENTS

| | | | |
|---|---|---|---|
| 3,508,021 | 4/1970 | Bellis | 200/302 |
| 3,887,778 | 6/1975 | Farrall | 200/144 B |
| 3,996,437 | 12/1976 | Selzer | 200/83 C |
| 3,996,438 | 12/1976 | Kurtz | 200/146 AA |

*Primary Examiner*—Robert K. Schaefer
*Assistant Examiner*—Len Pojunas
*Attorney, Agent, or Firm*—Haseltine, Lake & Waters

[57] ABSTRACT

A vacuum switch incorporating two contact elements arranged in an evacuated housing, the contact elements being in contact with one another in the closed condition of the switch and being separable from one another for cutting-off the current. As to the two contact elements at least one is movable in one direction. At least the movable contact element is secured to a support element which is movably guided in the direction of movement of such contact element and possesses a current terminal separate from the support element.

9 Claims, 2 Drawing Figures

32
38
45
42
A
30
34
24
40
44
26
22
36
20
28
30a
46
20a
28a
21
29a
29
31a
27
23
37
35
25
31
41
43
39
B
47
33

VACUUM SWITCH

BACKGROUND OF THE INVENTION

The present invention relates to a new and improved construction of a vacuum switch of the type incorporating two contact elements arranged in an evacuated housing, the contact elements being in contact with one another when the switch is closed and can be disconnected from one another for the purpose of cutting-off the current, and wherein at least one of the contact elements is movable in one direction.

At the present time there are designed vacuum switches for rated cut-off current intensities up to 50 kA and greater. Such cut-off current intensities correspond to asymmetrical cut-in current intensities exceeding 100 kA (peak value). Additionally, the external dimensions of the switch are increasingly becoming smaller in order to reduce the distance between the phases. This development has as a consequence thereof that the electrodynamic forces, which are exerted by the current-carrying components upon one another, always become greater, so that the danger exists that the mechanical strength of the current-carrying components, normally fabricated of copper, is no longer sufficient to prevent permanent deformation thereof. This is especially so with respect to the contact elements, particularly the movable contact elements.

SUMMARY OF THE INVENTION

Hence, it is a primary object of the present invention to provide an improved construction of vacuum switch which is capable of satisfying the aforementioned need existing in the art.

Another and more specific object of the present invention aims at the provision of a vacuum switch of the previously mentioned type which, with relatively small dimensions is capable of withstanding the mechanical loads arising in the presence of high cut-off current intensities.

Now, in order to implement these and still further objects of the invention, which will become more readily apparent as the description proceeds, the vacuum switch of this development is manifested by the features that at least the movable contact element is secured to a support element. The element is displaceably guided in the direction of movement of this contact element and possesses a current terminal or connection which is separate from the support element.

BRIEF DESCRIPTION OF THE DRAWINGS

The invention will be better understood and objects, other than those set forth above, will become apparent when consideration is given to the following detailed description thereof. Such description makes reference to the annexed drawings wherein.

DETAILED DESCRIPTION OF THE INVENTION

Figure 1:
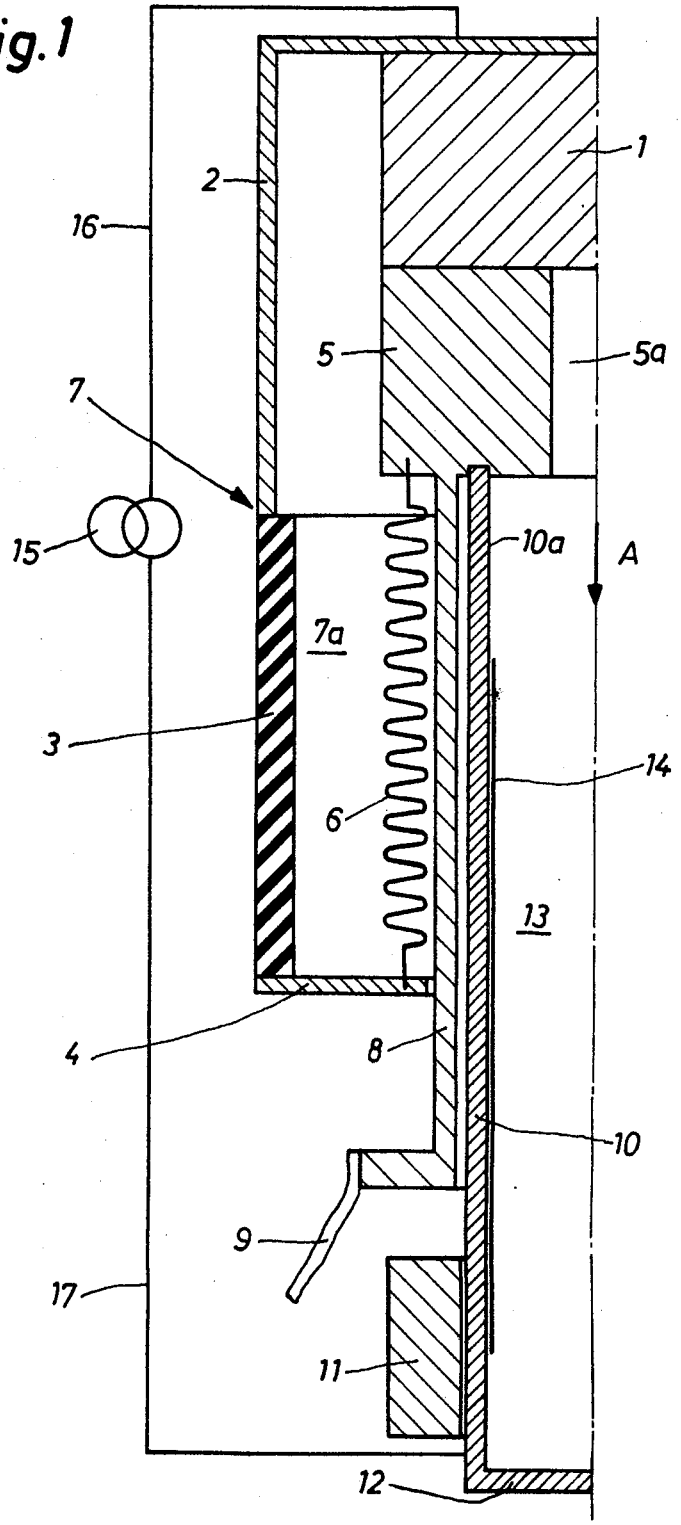
FIG. 1 is a longitudinal sectional view through one half of a vacuum switch having a movable contact element and designed according to the teachings of the present invention.

Describing now the drawings, the switch shown by way of example in FIG. 1 will be seen to comprise a stationary upper contact element 1 which is connected with the upper metallic housing portion 2. This upper housing portion 2 is connected through the agency of a part or component 3 formed of insulating material, for instance glass, with the lower metallic housing portion or component 4.

Cooperating with the upper contact element 1 is a lower contact element 5 movable in the direction of the arrow A. The movable contact element 5, in the illustrated closed condition of the switch, is in contact with the upper contact element 1 and can be disconnected from the latter for the purpose of interrupting or cutting-of the current. At the center the movable contact element 5 possesses a throughpassage opening **5*a***.

Between the lower housing portion 4 and the lower contact element 5 there is arranged an expansible metallic bellows or diaphragm 6 which closes in a vacuum tight manner, with respect to the surroundings, the interior or internal compartment **7*a* of the housing 7 formed by both housing portions 2 and 4 and the insulating portion 3. The internal compartment or interior space 7*a*** is evacuated, this being accomplished in any suitable conventional manner.

The movable contact element 5 possesses a substantially tubular-shaped current connection or terminal 8 which is arranged externally of the housing 7 and is connected with a flexible current conductor 9. The contact element 5 is connected with a substantially tubular-shaped support element 10 which carries out exclusively a support function and does not serve for conducting the current. This support element 10 is displaceably guided by means of a guide 11 in the direction of the arrow A i.e. in the direction of movement of the contact element 5. The support element 10 is closed at its under side by means of a base portion 12.

The support element 10 can basically possess any random construction, yet it advantageously comprises a substantially cylindrical tube or pipe since with this shape the ratio of the resistance moment to mass assumes the greatest value. The support element 10 exerts a great resistance against the applied electrodynamic forces, so that also in the case of very high current intensities the contact elements 1,5 can be sufficiently held in their mutually aligned position.

The hollow space or compartment 13 which is closed with respect to the surroundings and formed by the support element 10 is in flow communication via the throughpassage opening **5*a* of the contact element 5 with the internal space or compartment 7*a* of the housing 7 and therefore is equally subjected to the vacuum conditions. At the inner wall 10*a* of the support element 10 there can be applied a layer 14** of a suitable getter material serving to maintain the vacuum.

The getter material advantageously is initially applied in the form of an inactive powder, for instance $TiH_4$-powder, to the inner wall **10*a* of the support element 10 and after heating of the entire switch, which occurs for instance at a temperature of about 650° C, heated. In order to heat the powder the support element 10 is heated by means of a heating circuit composed of a transformer 15 and two infeed conductors or lines 16 and 17 connected with the upper housing portion 2 and the support element 10 respectively, whereby the powder assumes its active condition or state. If, as already mentioned, there is applied for instance a $TiH_4$-powder, then the support element 10** is heated to approximately 800° C and the $TiH_4$-powder is reduced to active titanium.

In order to open the switch the support element 10 is moved downwardly in the direction of the arrow A, and consequently the lower contact element 5 separates from the upper contact element 1. The closing occurs in corresponding reverse manner. With this movement the current terminal or connection 8 is practically not subjected to any mechanical load.

Figure 2:
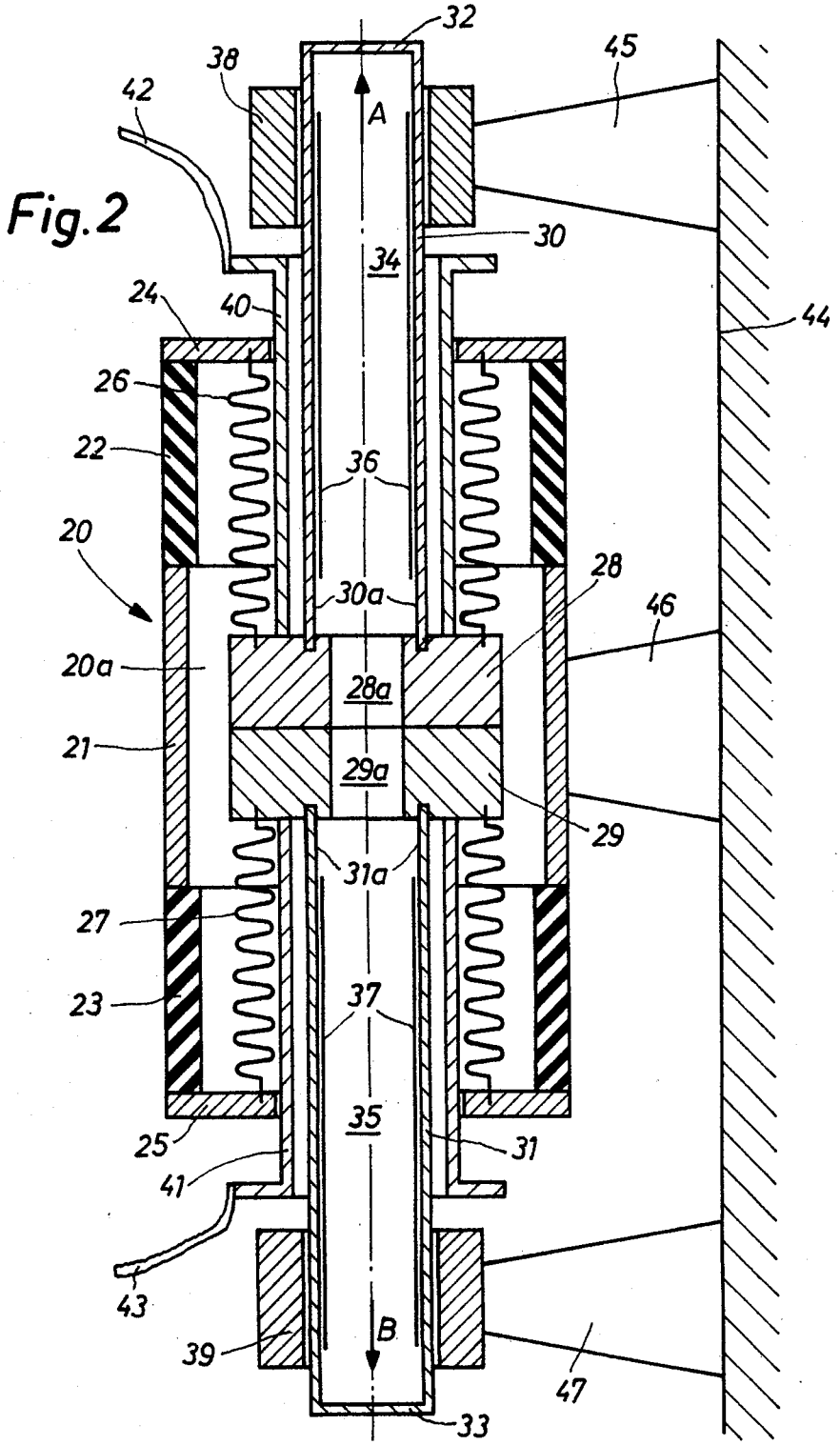
FIG. 2 is a longitudinal sectional view of a vacuum switch wherein both contact elements are movable.

Continuing, in FIG. 2 there is schematically illustrated a vacuum switch having two movable contact elements or members, wherein in this case each contact element is constructed like the movable contact element 5 of the embodiment of FIG. 1. This vacuum switch will be seen to comprise a housing 20 composed of a metallic intermediate component or portion 21 which is connected at both ends with an insulating portion 22 and 23 respectively, and a metallic cover portion 24 and base or floor portion 25. The interior or internal compartment 20*a* of the housing 20 is closed in a vacuum tight manner with respect to the surroundings by two expansible metallic bellows 26,27. The one metallic bellows 26 is attached to the cover portion 24 and at the upper contact element 28, whereas the other metallic bellows 27 is secured to the base or floor portion 25 and at the lower contact element 29.

Each of the contact elements 28 and 29 is provided at the center with a throughpassage opening 28*a* and 29*a* respectively, and is attached to a tubular-shaped support element 30 and 31 respectively. Each support element 30 and 31 is closed by means of a base or floor portion 32 and 33 respectively, so that there is formed an inner space or compartment 34 and 35 respectively, each of which is closed with respect to the surroundings and is in flow communication via the respective throughpassage opening 28*a* and 29*a* with the evacuated housing interior or internal compartment 20*a*. At the respective inner wall 30*a* and 31*a* of each support element 30 and 31, respectively, there is applied a layer 36 and 37 respectively, of a suitable getter material. In order to guide the support elements 30 and 31 in the direction of movement A and B, respectively, of the contact elements 28 and 29 there are provided the guides 38 and 39 respectively.

Each contact element 28 and 29 is provided with a tubular-shaped current terminal or connection 40 and 41 respectively, which is arranged between the support elements 30 and 31 and the metallic bellows 26 and 27, respectively, and at which there is connected a flexible current conductor 42 and 43 respectively.

In order to attach the vacuum switch at a stationary component 44, for instance a wall, there are provided attachment elements 45, 46 and 47. The attachment elements 45 and 47 are constructed as insulators and secured at one end at the component 44 and at the other end at the guides 38 and 39.

The attachment element 46, which is secured at the stationary component 44 and at the metallic housing portion 21 can be constructed as an insulator or can consist of electrically conductive material.

Upon opening the switch of the arrangement of FIG. 2 both of the contact elements 28 and 29 are moved away from another in the direction of the arrows A and B respectively. By virtue of the fact that both contact elements 28 and 29 are moved, the insulating components 22 and 23 in contrast to the switch of FIG. 1, are not exposed to any appreciable mechanical load.

The application of the inner layers 36, 37 formed of getter material to the inner walls 30*a*, 31*a* of the support elements 30, 31 can be carried out in the manner already described in conjunction with the embodiment of FIG. 1.

With both described exemplary embodiments the contact elements 1, 5, 28 and 29 are constructed as full electrodes. Yet it is also however possible to construct the contact elements as arc electrodes formed of electrode plates for taking-up the base points of the arc which is formed upon separation of the contact elements. Such arc electrodes are described for instance in Swiss Pat. No. 531.784, the disclosure of which is incorporated herein by reference.

The internal spaces or compartments 13, 34 and 35 of the tubular-shaped support elements 10, 30 and 31 respectively, can serve as extinguishing- and condensation compartment. For this purpose there can be provided in such internal compartments means for the condensation of the metallic vapors which are formed when the arc burns, as has been described for instance in Swiss Pat. No. 554,595, the disclosure of which is equally incorporated herein by reference.

While there is shown and described present preferred embodiments of the invention, it is to be distinctly understood that the invention is not limited thereto, but may be otherwise variously embodied and practice within the scope of the following claims. ACCORDINGLY,

What is claimed is:

1. A vacuum switch employing an evacuated housing, first and second contact element means arranged within said housing, said contact element means being in contact with one another during the closed condition of the switch and being disconnectable from one another for current cut-off, said switch including: said first contact element means being movable in one direction, support means, said first contact element means being secured to said support means, guiding means disposed externally of said housing for guiding the said support means for movement in the direction of movement of said first contact element means, said support means being of substantially hollow cylindrical construction and secured to the said first contact element means at a position opposite said second contact element means; and a current terminal separate from said support means cooperating with said first contact element means.

2. A vacuum switch as claimed in claim 1, wherein: said second contact element means being movable in a direction opposite to the direction of movement of said first contact element means, said second contact element means being secured to second contact support means, second guiding means for guiding said second support element means, being disposed externally of said housing for movement in the direction of movement of said second contact element means, said second contact support element means being of substantially hollow cylindrical construction and being secured to said second movable contact element means at a position opposite to said first contact element means, a second current terminal separate from said second contact support means.

3. A vacuum switch as claimed in claim 1, wherein: said contact support element means being provided with a closed hollow compartment, and each of said contact element means being provided with a throughpassage communicating with said hollow compartment and an interior of said housing.

4. A vacuum switch as claimed in claim 1, including: an expansible substantially hollow cylindrical bellows arranged between said housing and each of said movable contact element means, said expansible bellows being extensible in the direction of movement of said contact element means and the interior being adapted to close said housing interior in a vacuum tight fashion.

5. A vacuum switch as claimed in claim 2, wherein: said current terminal of each of said contact element means being of a substantially hollow cylindrical construction and being arranged substantially coaxially with respect to associated contact support means.

6. A vacuum switch as claimed in claim 4, wherein: each current terminal being arranged between associated support means and said bellows.

7. A vacuum switch as claimed in claim 1, wherein: said support means being defined by an inner wall provided with a layer of a getter material.

8. A vacuum switch as claimed in claim 1, wherein: said respective contact element means being defined by arc electrodes incorporating electrode plates for taking-up the base points of the arc.

9. A vacuum switch as claimed in claim 3, wherein: said respective support element means being provided with a hollow compartment containing means for condensing metallic vapors produced during burning of the arc.

* * * * *